US006206256B1

(12) United States Patent
Marzocchi

(10) Patent No.: US 6,206,256 B1
(45) Date of Patent: Mar. 27, 2001

(54) NEEDLE FOR ATTACHING A TAG TO AN INFUSION BAG USING AN INTERMEDIATE KNOTTED THREAD

(75) Inventor: Paolo Marzocchi, Terme (IT)

(73) Assignee: I.M.A. Industria Macchine Automatiche S.p.A., Ozzano Dell Emila (IT)

( * ) Notice: Subject to any disclaimer, the term of this patent is extended or adjusted under 35 U.S.C. 154(b) by 0 days.

(21) Appl. No.: 09/554,121

(22) PCT Filed: Sep. 16, 1999

(86) PCT No.: PCT/IB99/01549

§ 371 Date: May 5, 2000

§ 102(e) Date: May 5, 2000

(87) PCT Pub. No.: WO00/17054

PCT Pub. Date: Mar. 30, 2000

Related U.S. Application Data

(60) Provisional application No. PCT/IB99/01549, filed on Sep. 16, 1999.

(30) Foreign Application Priority Data

Sep. 18, 1998 (IT) ..... BO98A0537

(51) Int. Cl.[7] ..... A41B 9/00
(52) U.S. Cl. ..... 223/102; 112/222
(58) Field of Search ..... 223/102; 112/222; 606/222, 223

(56) References Cited

U.S. PATENT DOCUMENTS 2,006,356 7/1935 Irmscher .
3,060,876 * 10/1962 Surbeck ..... 223/102
3,403,647 * 10/1968 Supitar ..... 112/222
3,503,353 * 3/1970 Matthews ..... 223/102
6,062,151 * 5/2000 Meade et al. ..... 112/222

FOREIGN PATENT DOCUMENTS 26 23 796 6/1977 (DE) .
0 270 780 A2 6/1988 (EP) .
0 691 268 A1 1/1996 (EP) .
96/31395 10/1996 (WO) .

* cited by examiner

*Primary Examiner*—Bibhu Mohanty
(74) *Attorney, Agent, or Firm*—Pillsbury Madison & Sutro LLP

(57) ABSTRACT

An improved needle (1) to attach a filter bag (2) containing a product for infusion to a pick-up tag (3) using a thread (4) knotted at least at one of its end sections (5; 6) comprises two eyes (7, 8) located at different distances from the point (9) of the needle (1). The first eye (7) is designed to hook the thread (4), stretched and retained at the end sections (5, 6) and to make a loop (10) in the thread when the needle (1) is pulled in the direction of its axis (1*a*). The second eye (8), on the other hand, is located closer to the point (9) and is oriented at right angles to the first eye (7) so that it can be surrounded by the loop (10) and can guide an end section (5; 6) of the thread (4) across the loop (10) to make a knot. The needle (1) also comprises two lengthways grooves (11) that connect the first eye (7) to the second eye (8) and that are especially shaped to accommodate the loop (10) and to keep it in position while the knot is being formed.

10 Claims, 3 Drawing Sheets

NEEDLE FOR ATTACHING A TAG TO AN INFUSION BAG USING AN INTERMEDIATE KNOTTED THREAD

This application is the national phase of international application PCT/IB99/01549 filed Sep. 16, 1999 which designated the U.S.

TECHNICAL FIELD

The present invention relates to the manufacture of filter bags containing products for infusion such as tea, camomile, or other herbs, each bag being made from filter paper folded over itself, sealed and attached to the pick-up tag by an intermediate thread knotted at the ends.

BACKGROUND ART

At the present time, the thread is attached to the filter bag and to the pick-up tag by knotting when high quality filter bags are required, differing from similar kinds of bags in; that all the parts of them that come into contact with the infusion cannot have even the least harmful effects on health and (also very important from the commercial viewpoint) cannot alter the taste of the infusion. For example, bad effects on health and taste may be produced when the filter paper forming the bag is sealed using hot-melt glue or when the top of the bag is closed using metal staples which are also used to attach the thread to the bag.

The present invention relates in particular to an improved needle of the type comprising two eyes located at different distances from the needle point, the first eye being designed to hook the thread, stretched and retained at the end sections and to make a loop in the thread when the needle is pulled in the direction of its axis; and the second eye being located closer to the point and oriented at right angles to the first eye so that it can be surrounded by the loop and can guide an end section of the thread across the loop to make a knot. A needle of this type is disclosed in Italian patent application No. BO95 A000J48.

In an improved machine forming the subject matter of another application filed at the same time by the same Applicant, the loop, before being crossed by the section of thread that will make the knot, is also twisted by turning the needle about its axis one or more times, which reduces the size of the loop and gradually tightens it around the lateral surface of the needle.

In both these solutions, apart from the constraints posed by the way the thread is hooked to the eye and the extent of the pulling force exerted by the needle itself, the loop adapts to the surface of the needle quite freely. When the thread is pulled by the needle, the loop assumes a flat configuration. As the loop is twisted, the plane in which it originally lay is gradually distorted and the more the loop is twisted, the more its plane is distorted.

Under certain working conditions, the distortion of the loop against the lateral surface of the needle in this way can result in a not entirely correct position of the loop relative to the second eye of the needle which, as is well known, acts as a guide for special threading elements used to insert an end section of the thread into the loop.

Although this problem can be avoided by accurate setting up and frequent adjustment, there is room to improve machines of this kind so that they maintain the correct setup for a longer time without requiring frequent adjustments.

DISCLOSURE OF THE INVENTION

The present invention has for an object to overcome the above mentioned problems by providing a needle made in such a way that it can constrain the loop in a well-defined, geometrical configuration which can be continuously repeated and which is independent of the amount of pulling force exerted by the needle and/or of the number of times the loop is turned about the axis of the needle in order to twist it.

According to the invention, this object is achieved by an improved needle, made according to the preamble to claim 1, characterized in that it comprises two lengthways grooves that connect the first eye to the second eye and that are especially shaped to accommodate the loop and to keep it in position while the knot is being formed.

The needle may also have a lateral guide element designed to guide the thread and projecting from the lateral surface of the needle point. The giude element engages at least one branch of the looped thread in such a way that the loop is twisted in a strictly controlled manner when the needle is turned about its axis.

The technical characteristics of the invention are described in the claims below and its advantages are apparent from the detailed description which follows with reference to the accompanying drawings, which illustrate a preferred embodiment of the invention and in which:

Figure 5:
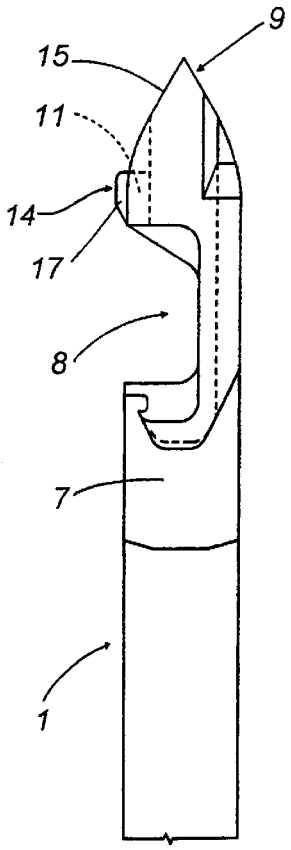
FIG. 5 is a side view from "B" of the needle illustrated in FIG. 1.

FIGS. 9*a*, 9*b*, 9*c*, 9*d* schematically illustrate a part of the working cycle performed by the needle.

With reference to the drawings listed above, the invention relates to an improved needle 1 used to attach a filter bag 2, containing a product for infusion, to a pick-up tag 3 using an intermediate thread 4 which is knotted at its end sections (5; 6) to the filter bag 2 on one side and to the pick-up tag 3 on the other side, according to a method that is partly known, and some of the steps of which are schematically illustrated in FIGS. 9*a*, 9*b*, 9*c* and 9*d*.

Figure 1:
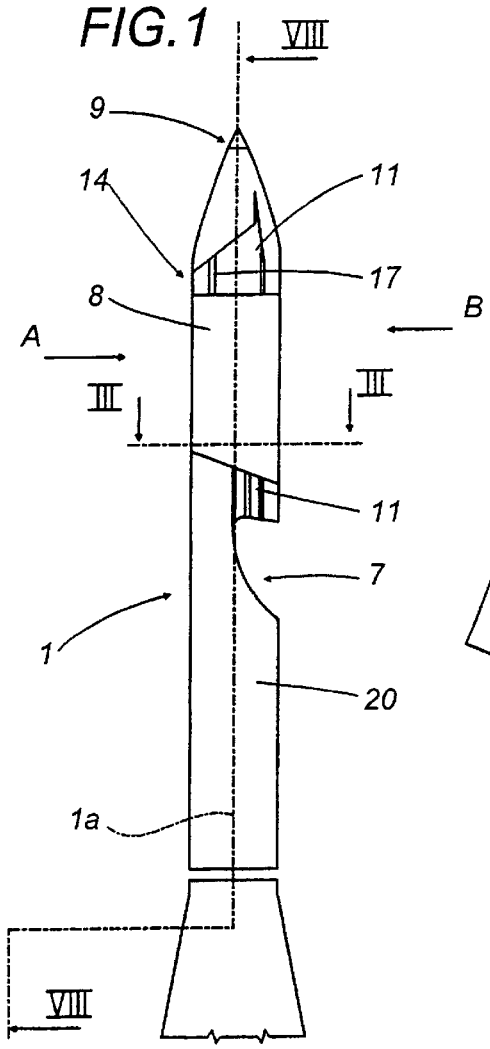
FIG. 1 is a greatly scaled-up side view of a needle made according to the present invention.
Figure 4:
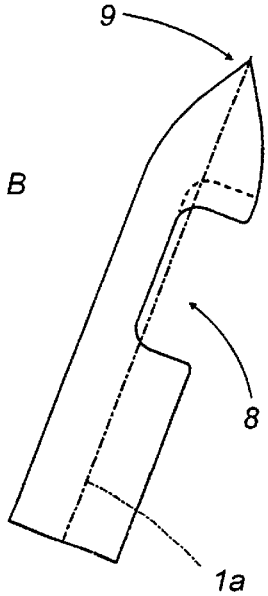
FIG. 4 is a side view of a detail of the needle viewed from side "A"
Figure 2:
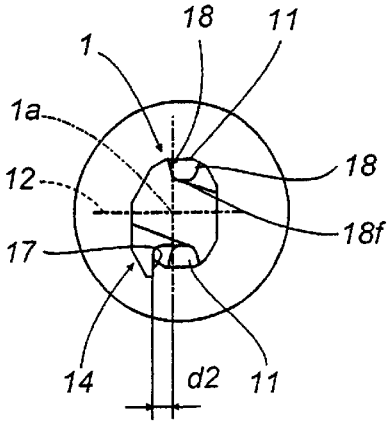
FIG. 2 is a top plan view of the needle illustrated in FIG. 1.
Figure 3:
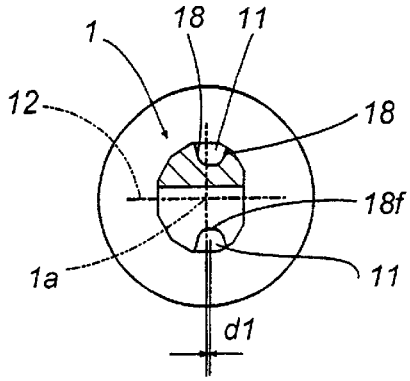
FIG. 3 is a cross section of the needle through line III—III in FIG. 1.

The needle 1 (FIG. 1) basically comprises an elongated body 20 terminating at a sharp point 9. The body 20 is cylindrical at the bottom while, near the point 9, its cross section becomes curved or polygonal in shape, as shown in FIGS. 2 and 3.

Close to the point 9 on the body 20, there are two open eyes 7, 8 made on one side of the needle at different distances from the point 9.

The first eye 7, the one further away from the point 9, is designed to hook the thread 4 and is oriented in such a way that it extends at right angles to the axis 1*a* of the needle 1.

The second eye 8, closer to the point 9, is designed to guide special threading elements 21 of the thread 4, as described in more detail below. It extends obliquely to the axis 1*a* of the needle 1 and is oriented at right angles to the first eye 7.

Figure 8:
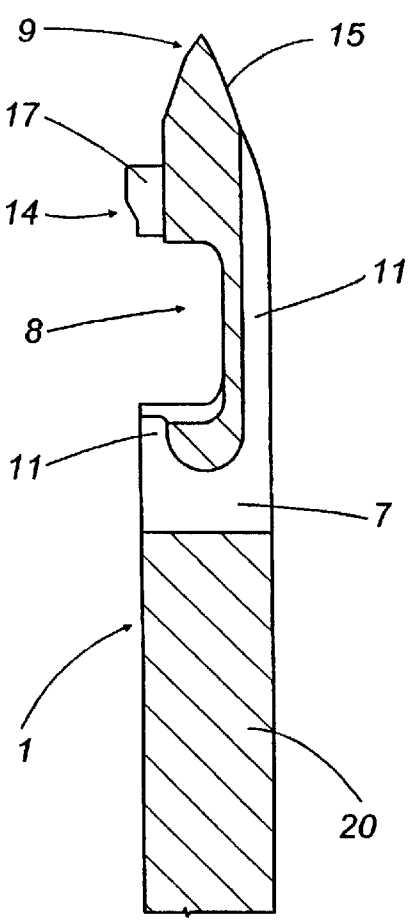
FIG. 8 is a cross section of the needle through line VIII—VIII in FIG. 1.
Figure 7:
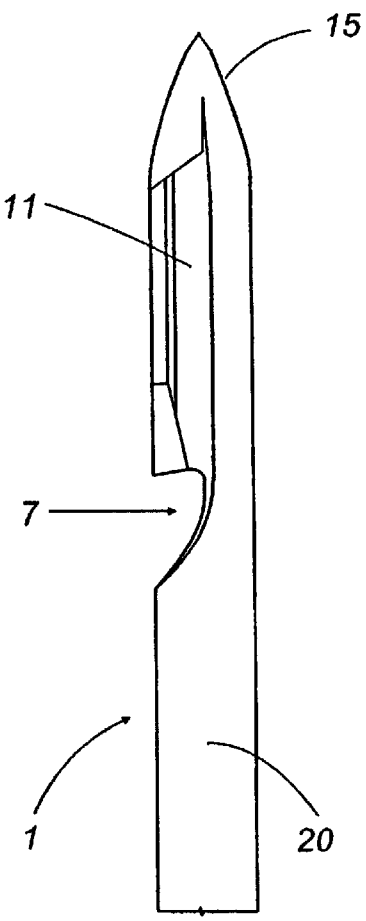
FIG. 7 is a side view of the needle corresponding to FIG. 1, rotated by 180°.
Figure 6:
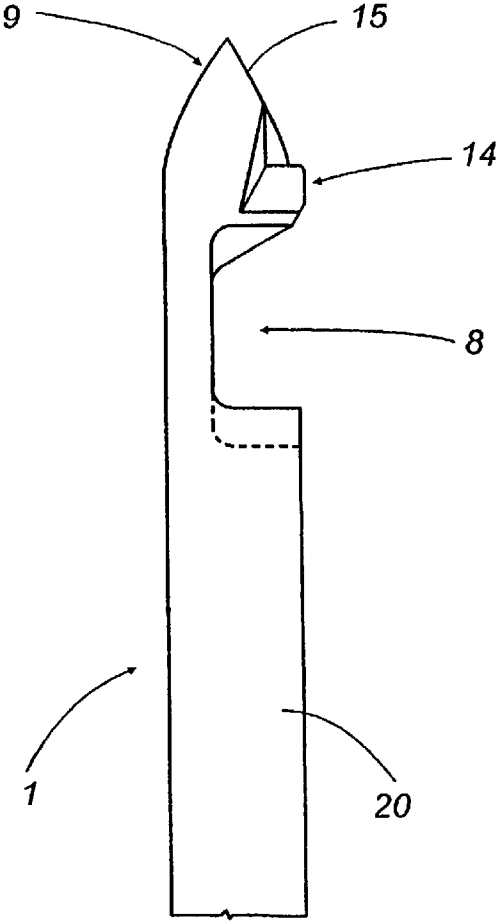
FIG. 6 is a side view of the needle corresponding to FIG. 5, rotated by 180°.

The needle 1 also comprises two straight, lengthways grooves 11, which extend longitudinally along the lateral surface of the needle 1 from the point 9 and down as far as the farther eye 7 (the first eye). The grooves 11 together surround the second eye 8 whose open side intercommunicates with one of the grooves (see FIGS. 5 and 8).

Looking in more detail (see FIGS. 2 and 3), the grooves 11 are located symmetrically about a plane 12 through the axis of rotation 1*a* of the needle 1 and are offset from the axis 1*a* by a given dimension "d1" measured in a direction parallel to the plane 12. Their sidewalls 18 are tapered, converging towards the bottom 18*f* of each groove 11 with which they form smooth, rounded corners.

The needle 1 further comprises a lateral guide element 14 for the thread 4, which projects from the lateral surface 15 of the point 9 of the needle 1 and which engages at least one branch 16 of the looped portion 10 of thread in such a way as to correctly control the way the loop 10 is twisted when the needle 1 is turned about its axis 1*a*.

The guide element 14 is located on the point 9 of the needle 1, in a position adjacent to the second eye 8. It also has a planar face 17 located on one side of one of the grooves 11 for the thread 4, that is, the groove that intercommunicates with the second eye 8.

The planar face 17 is parallel to the lengthways axis 1*a* of the needle 1 and is offset from said axis 1*a* by a dimension d2 measured in a direction parallel to the plane 12. The dimension d2 is measured on the side of the axis 1*a* of the needle 1 opposite that on which dimension d1 is measured.

The operation of the needle 1 can be described with reference to the accompanying illustrations, starting from FIG. 9*a*, in which two needles 1 made according to the invention and used to knot the thread 4 to the filter bag 2 and to the tag 3, are shown as they are pushed through the filter bag 2 and the tag 3 in a direction parallel to the axis 1*a* of each, as indicated by the arrows 22, until the first eye 7 of each needle hooks the thread 4 while the latter is being stretched and retained at its end sections 5, 6 according to a method well known to experts in the trade.

Figure 9B:
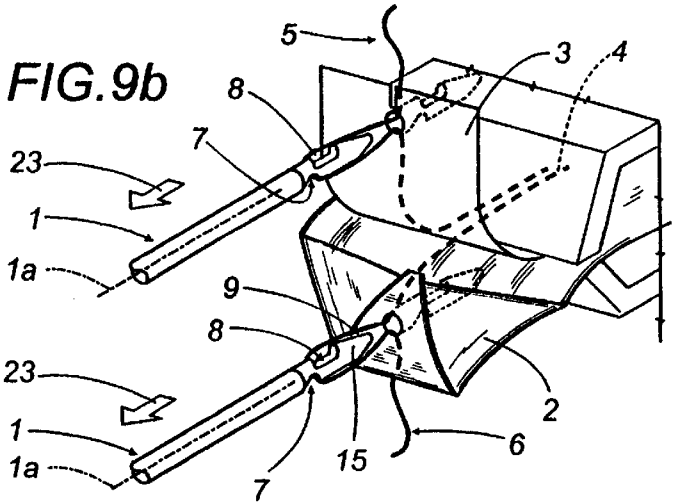
Figure 9D:
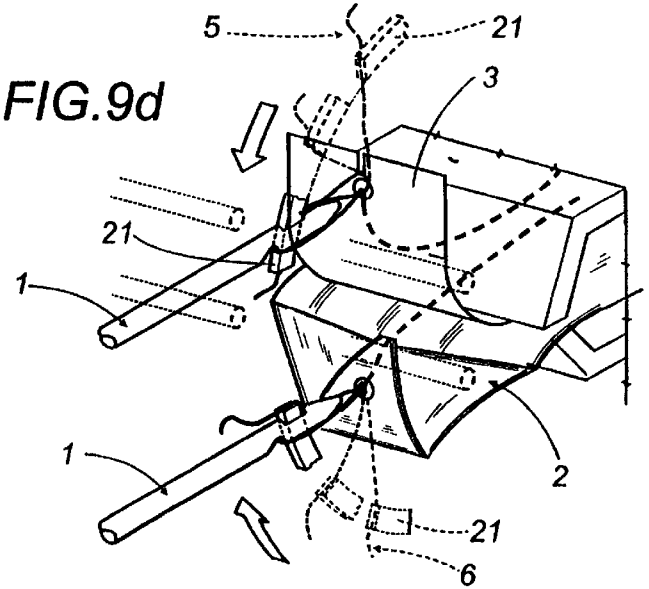
Figure 9A:
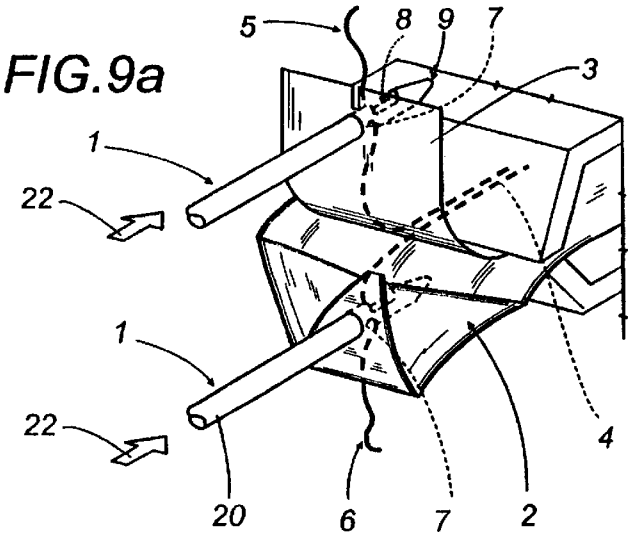

Next, with a movement in the opposite direction, as indicated by the arrows 23 in FIG. 9*b*, the needles 1 are pulled back out of the filter bag 2 and the tag 3, dragging with them the corresponding end sections 5, 6 each of which thus forms a loop 10 hooked to the first eye 7 of the corresponding needle 1. During this movement, each loop 10 is seated in the grooves 11 which hold it in such a way that it keeps a well-defined geometrical shape.

Figure 9C:
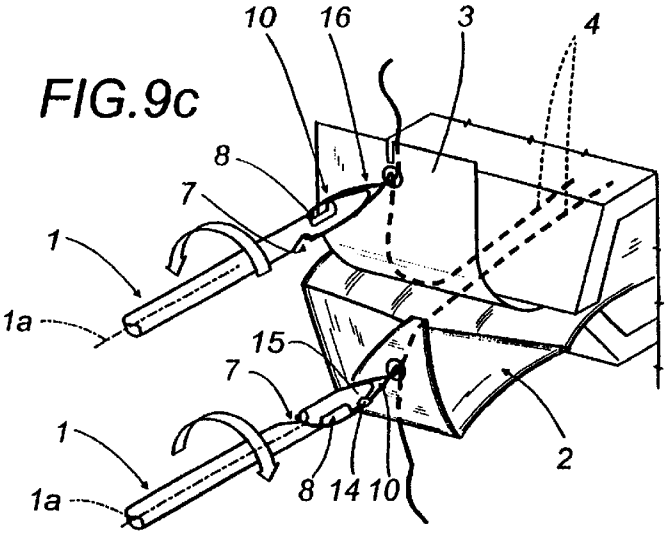

In the next step, illustrated in FIG. 9*c*, the needles 1 are turned repeatedly about their axes 1*a* so as to twist the loops 10, thanks also to the guide elements 14 made on the needles 1.

After a defined number of turns, which cause the loops 10 to close in against the lateral surfaces 15 of the needles 1, and after the eye 8 has been suitably oriented relative to the path of the threading elements 21, each of the latter pushes the corresponding end section 5;6 of the thread 4 through the corresponding loop 10 to form a loose knot which is then tightened in a manner well-known to experts in the trade.

The invention described can be subject to modifications and variations washout thereby departing from the scope of the inventive concept. Moreover, all the details of the invention may be substituted by technically equivalent elements.

What is claimed is:

1. A needle to attach a filter bag containing a product for infusion to a pick-up tag using an intermediate thread knotted at least at one of its end sections, the needle comprising:

two eyes located at different distances from a point of the needle, the first eye being constructed and arranged to hook the thread, stretched and retained at the end sections and to make a loop in the thread when the needle is pulled in the direction of its axis, the second eye being located closer to the point of the needle and oriented at right angles to the first eye such that it can be surrounded by the loop and can guide an end section of the thread across the loop to make a knot; and two lengthways grooves that connect at least the first eye to the second eye and that are constructed and arranged to accommodate the loop and to keep it in position while the knot is being formed.

2. The needle according to claim 1, wherein the grooves are straight.

3. The needle according to claim 1, wherein the grooves are located symmetrically about a plane through the axis of the needle.

4. The needle according to claim 3, wherein the grooves are offset from the axis of the needle by a defined dimension measured in a direction parallel to a plane of symmetry of the grooves and passing through the axis of the needle.

5. The needle according to claim 1, wherein its cross section is polygonal in shape.

6. The needle according to claim 1, further comprising at least one lateral guide element for the thread, which projects from the lateral surface of the point of the needle and which engages at least one branch of the looped portion of thread in such a way as to enable the loop to be twisted when the needle is turned about its axis.

7. The needle according to claim 6, wherein the guide element is located on the point of the needle, in a position adjacent to the second eye.

8. The needle according to claim 6, wherein the guide element has a planar face located on one side of one of the grooves which accommodate the thread.

9. The needle according to claim 8, wherein the planar face is parallel to the axis of the needle and is offset by a dimension measured in a direction parallel to a plane of symmetry of the grooves and passing through the axis of the needle.

10. The needle according to claim 1, wherein the sidewalls of the grooves are tapered and converge towards the bottom of each groove.

* * * * *